US007625104B2

(12) United States Patent
Zhang et al.

(10) Patent No.: US 7,625,104 B2
(45) Date of Patent: Dec. 1, 2009

(54) LIGHT EMITTING DIODE FOR MOUNTING TO A HEAT SINK

(75) Inventors: Li Zhang, San Jose, CA (US); Frank M. Steranka, San Jose, CA (US); Frank J. Wall, Jr., Vacaville, CA (US); Jeff Kmetec, Palo Alto, CA (US); Johannes Wilhelmus Weekamp, Beek en Donk (NL)

(73) Assignee: Philips Lumileds Lighting Company, LLC, San Jose, CA (US)

( * ) Notice: Subject to any disclaimer, the term of this patent is extended or adjusted under 35 U.S.C. 154(b) by 238 days.

(21) Appl. No.: 11/956,270

(22) Filed: Dec. 13, 2007

(65) Prior Publication Data

US 2009/0154166 A1 Jun. 18, 2009

(51) Int. Cl.
*F21V 29/00* (2006.01)

(52) U.S. Cl. ..... 362/294; 362/249.02; 362/373

(58) Field of Classification Search ..... None
See application file for complete search history.

(56) References Cited

U.S. PATENT DOCUMENTS

| | | | | |
|---|---|---|---|---|
| 6,517,218 | B2 | 2/2003 | Hochstein | |
| 6,582,100 | B1 | 6/2003 | Hochstein et al. | |
| 6,911,731 | B2 | 6/2005 | Wu | |
| 2006/0138443 | A1 * | 6/2006 | Fan et al. | 257/100 |
| 2007/0120138 | A1 * | 5/2007 | Sayers et al. | 257/99 |
| 2007/0170448 | A1 * | 7/2007 | Ito et al. | 257/98 |

* cited by examiner

*Primary Examiner*—Laura Tso

(57) ABSTRACT

A light emitting diode (LED) apparatus for mounting to a heat sink having a front surface with an opening therein is disclosed. The apparatus includes a sub-mount, at least one LED die mounted on the sub-mount, and a thermally conductive slug having first and second areas. The first area is thermally coupled to the sub-mount and the second area has a post protruding outwardly therefrom. The post is operably configured to be received in the opening in the heat sink and to secure the LED apparatus to the heat sink such that the second area is thermally coupled to the front surface of the heat sink. Other embodiments for mounting an LED apparatus utilizing adhesive thermally conductive material, spring clips, insertion snaps, or welding are also disclosed.

33 Claims, 8 Drawing Sheets

LIGHT EMITTING DIODE FOR MOUNTING TO A HEAT SINK

BACKGROUND OF THE INVENTION

1. Field of Invention

This invention relates generally to light emitting diodes (LEDs) and more particularly to mounting LEDs to a heat sink.

2. Description of Related Art

Light Emitting Diodes (LED) have generally been regarded as electronic components and as such have generally been mounted to printed circuit boards (PCB) using various soldering techniques, such as reflow soldering of surface mount packages, for example.

Advances in LED technology have lead to improved optical efficiency at lower manufacturing cost, and higher power LEDs are now available for use in general illumination applications, such as household and commercial lighting. Such applications have established a need for simple, low-cost mounting solutions for LEDs. Soldering may not be a suitable mounting and/or connection solution for lighting industries, which have traditionally relied on relatively low-tech connection and mounting technologies. Introducing solder technologies into such industries may represent a barrier to wider adoption of LED lighting components.

LEDs are also substantially more compact than traditional lighting devices such as incandescent and florescent bulbs, which presents a problem for heat removal, in that an LED has less surface area available for convective heat transfer to the surrounding air than traditional light bulbs.

When mounting an LED, there is a need to transfer heat generated by the LED to a body which is able to dissipate the heat to a surrounding ambient environment, thus maintaining the LED at a safe operating temperature. Mounting techniques used for conventional light sources (for example, incandescent bulbs, fluorescent tubes, etc) are generally not appropriate for use with LED devices, as conventional light sources generally do not have the same thermal transfer requirements as an LED. The majority of mounting techniques for conventional light sources are not useful for mounting compact LED sources (for example a powerful LED may be 1 mm×1 mm or smaller).

Accordingly, there remains a need for methods and apparatus for mounting LEDs.

SUMMARY OF THE INVENTION

In accordance with one aspect of the invention there is provided a light emitting diode (LED) apparatus for mounting to a heat sink, the heat sink having a front surface with an opening therein. The apparatus includes a sub-mount, at least one LED die mounted on the sub-mount, and a thermally conductive slug having first and second areas. The first area is thermally coupled to the sub-mount and the second area has a post protruding outwardly therefrom. The post is operably configured to be received in the opening in the heat sink and to secure the LED apparatus to the heat sink such that the second area is thermally coupled to the front surface of the heat sink.

The post may include a threaded portion operable to engage a threaded portion of the opening in the heat sink for securing the LED apparatus to the heat sink.

The thermally conductive slug may be operably configured to receive a wrench for applying a torque to secure the LED apparatus to the heat sink.

The heat sink may include a base having the opening therein, and may further include a cylindrical wall extending from the base and having an open end distal to the base, the cylindrical wall at least partially enclosing the LED apparatus and being operable to direct light generated by the LED die through the open end.

The post may include a threaded portion, which when received in the opening in the heat sink protrudes from a back surface thereof and is operably configured to receive a threaded nut for securing the LED apparatus to the heat sink.

The post may include a distal portion that protrudes from a back surface of the heat sink when received in the opening, the distal portion being operably configured to receive a spring clip for engaging the back surface of the heat sink to urge the second area into thermal coupling with the front surface of the heat sink.

The apparatus may include a thermally conductive material disposed on the second area, the thermally conductive material being operable to form an interface between the second area and the front surface of the heat sink when the LED apparatus is mounted on the heat sink thereby lowering a thermal resistance therebetween. The apparatus also may include a spring clip disposed on a distal portion of the post, the spring clip having at least one portion operably configured to be compressed flush against the post while being received in the opening in the heat sink, the thermally conductive material being sufficiently compliant to permit the LED apparatus to be depressed against the front surface of the heat sink to a sufficient extent to permit the at least one portion of the spring clip to engage the back surface of the heat sink to urge the second area into thermal coupling with the front surface.

The slug may include at least one channel for receiving at least one conductor for supplying current to the at least one LED die.

The at least one channel may extend through the post to facilitate routing the at least one conductor to the back surface of the heat sink.

The apparatus may include a thermally conductive material disposed on the second area, the thermally conductive material being operable to form an interface between the second area and the heat sink when the LED apparatus may be mounted on the heat sink thereby lowering a thermal resistance therebetween.

The apparatus may include at least one terminal in electrical connection with the at least one LED die, the terminal being operable to receive and secure an electrical conductor for supplying operating current to the at least one LED die.

In accordance with another aspect of the invention there is provided a light emitting diode (LED) apparatus for mounting to a heat sink. The apparatus includes a sub-mount, at least one LED die mounted on the sub-mount, and a thermally conductive slug having first and second areas. The first area is thermally coupled to the sub-mount. The apparatus also includes a thermally conductive material disposed on the second area of the slug, the thermally conductive material having an outer surface having adhesive properties for securing the LED apparatus to the heat sink such that the second area is thermally coupled to the front surface of the heat sink.

The thermally conductive material may include a thermally conductive material layer having an inner surface and an outer surface, a first adhesive layer disposed on the inner surface, the first adhesive layer being operable to bond the thermally conductive material layer to the second area, and a second adhesive layer on the outer surface.

The slug may be operably configured to be received in a corresponding recess in the heat sink, the recess being operable to facilitate alignment of the LED apparatus to the heat sink.

The apparatus may include a removable protective film disposed on the outer surface, the protective film being operably configured to be removed prior to securing the LED apparatus to the heat sink.

The apparatus may include at least one terminal in electrical connection with the at least one LED die, the terminal being operable to receive and secure an electrical conductor for supplying operating current to the at least one LED die.

In accordance with another aspect of the invention there is provided a light emitting diode (LED) apparatus for mounting to a heat sink having a pair of spring clips attached to a front surface of the heat sink, each spring clip having a free end. The apparatus includes a sub-mount, at least one LED die mounted on the sub-mount, and a thermally conductive slug having first and second areas. The first area is thermally coupled to the sub-mount. The apparatus also includes first and second slots located on opposite sides of an upper surface of the LED apparatus, the first and second slots being operable to receive respective free ends of the spring clips such that the second area of the slug is urged into thermal coupling with the heat sink when the LED apparatus is mounted on the heat sink.

The apparatus may include an electrically insulating body formed around at least a portion of the slug and the first and second slots may be formed in the electrically insulating body.

The apparatus may include an upwardly inclined ramp portion leading to each of the first and second slots, the ramp portion being oriented to receive respective free ends of the spring clips and being operable to guide the free ends into engagement with the respective first and second slots.

The second area of the slug may be operably configured to be received in a recess formed in the front surface of the heat sink, the recess being operable to locate the LED apparatus on the heat sink.

The apparatus may include a thermally conductive material disposed on the second area, the thermally conductive material being operable to form an interface between the second area and the heat sink when the LED apparatus may be mounted on the heat sink thereby lowering a thermal resistance therebetween.

The apparatus may include at least one terminal in electrical connection with the at least one LED die, the terminal being operable to receive and secure an electrical conductor for supplying operating current to the at least one LED die.

In accordance with another aspect of the invention there is provided a light emitting diode (LED) apparatus for mounting to a front surface of a heat sink, the heat sink having at least one opening formed therethrough. The apparatus includes a sub-mount having an upper surface and a lower surface, at least one LED die mounted on the upper surface of the sub-mount, and a conductor strip bonded to the upper surface of the sub-mount adjacent the LED die and in electrical connection with the LED for supplying operating current thereto. The conductor strip has at least one connector portion that depends downwardly from the upper surface of the sub-mount. The apparatus includes an electrically insulating body molded around at least a portion of the connector portion and having an insertion snap proximate the connector portion, the insertion snap being operably configured to be received in the opening and to engage a back surface of the heat sink to secure the LED apparatus to the heat sink such that the lower surface of the sub-mount is thermally coupled to the front surface of the heat sink.

The connector portion may include a v-shaped cutout at a distal end thereof, the v-shaped cutout being operable to receive a current supply conductor and to displace an insulation layer on the current supply conductor to establish electrical contact with the connector for supplying current to the LED die.

The apparatus may include a thermally conductive material disposed on the lower surface of the sub-mount, the thermally conductive material being operable to form an interface between the lower surface and the heat sink when the LED apparatus may be mounted on the heat sink thereby lowering a thermal resistance therebetween.

In accordance with another aspect of the invention there is provided a light emitting diode (LED) apparatus for mounting to a heat sink, the LED apparatus. The apparatus includes a sub-mount, at least one LED die mounted on the sub-mount, and a metallic slug having first and second areas, the first area being thermally coupled to the sub-mount and the second area having a metallic stud protruding outwardly therefrom, the stud being operably configured to conduct a welding current from the slug to the heat sink to cause the LED apparatus to be welded to the heat sink such that the second area is thermally coupled to the heat sink.

The apparatus may include at least one terminal in electrical connection with the at least one LED die, the terminal being operable to receive and secure an electrical conductor for supplying operating current to the at least one LED die.

In accordance with another aspect of the invention there is provided a process for mounting a light emitting diode (LED) apparatus to a metallic heat sink, the LED apparatus including a sub-mount, at least one LED die mounted on the sub-mount, and a metallic slug having first and second areas, the first area being thermally coupled to the sub-mount, the method. The process involves causing the second area of the slug to be positioned proximate the heat sink, and coupling a charged capacitor to the slug to establish a welding current between the second area of the slug and the heat sink for welding the slug to the heat sink.

Causing the second area of the slug to be positioned proximate the heat sink may involve receiving the LED apparatus in a chuck, the chuck being operably configured to engage a surface of the heat sink such that the second area of the slug may be positioned in spaced apart relation to the heat sink.

Causing the second area of the slug to be positioned proximate the heat sink may involve receiving the LED apparatus in a chuck, the chuck being operably configured to engage a surface of the heat sink such that the second area of the slug engages the heat sink.

Causing the second area of the slug to be positioned proximate the heat sink may involve causing a stud protruding outwardly from the second area of the slug to engage the heat sink, the stud being operable to conduct the welding current from the slug to the heat sink thereby melting the stud and at least a portion of the second area of the slug to cause the slug to be welded to the heat sink.

Causing the second area of the slug to be positioned proximate the heat sink may involve causing a stud protruding outwardly from the second area of the slug to be spaced apart from the heat sink, the stud being operable to conduct the welding current from the slug to the heat sink thereby melting the stud and at least a portion of the second area of the slug to cause the slug to be welded to the heat sink.

Coupling the charged capacitor to the slug may involve receiving the LED apparatus in a chuck, the chuck having a conductive portion for electrically contacting the slug, and coupling the charged capacitor to the conductive portion of the chuck.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
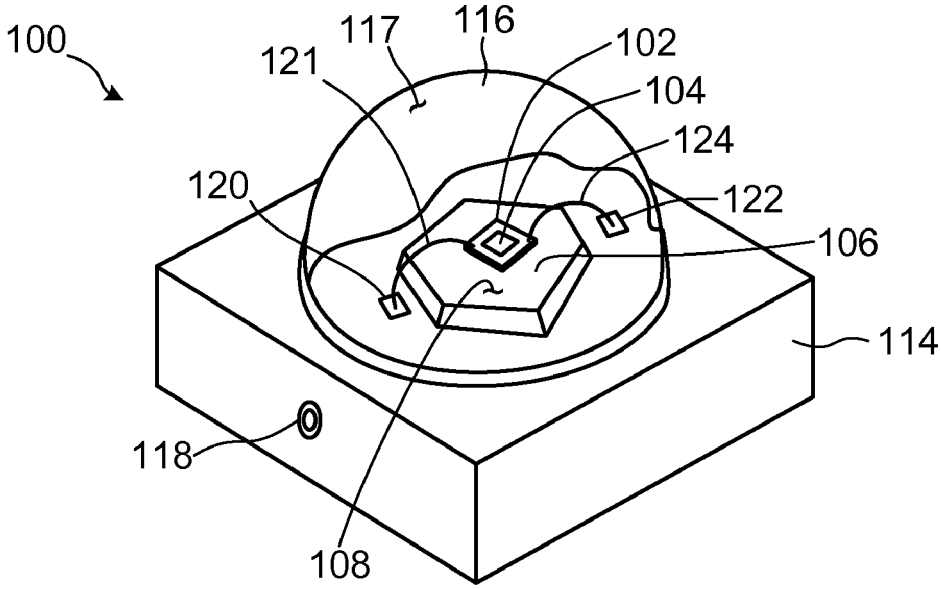
FIG. 1 is a perspective view of an LED apparatus in accordance with a first embodiment of the invention.
Figure 2:
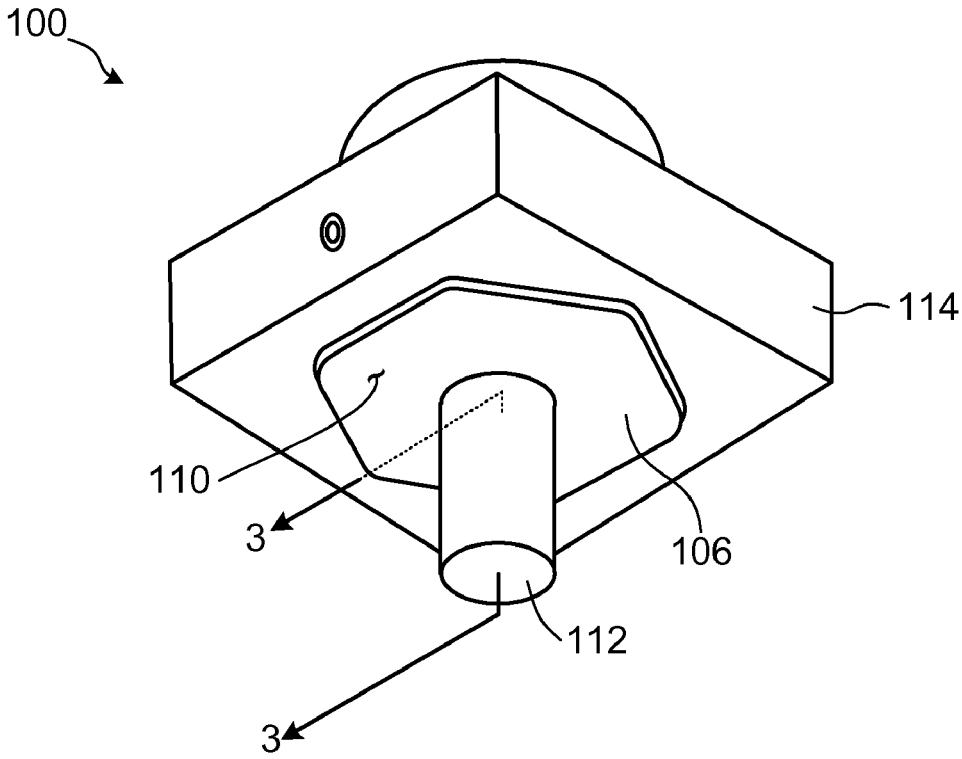
FIG. 2 is another perspective view of the LED apparatus shown in FIG. 1.

An LED apparatus according to a first embodiment of the invention is shown generally at 100 in FIG. 1 and FIG. 2. Referring to FIG. 1, the LED 100 includes a sub-mount 102 and at least one LED die 104 mounted on the sub-mount. The sub-mount 102 may comprise ceramic or silicon material, for example. The LED 100 also includes a thermally conductive slug 106 having first and second areas 108 and 110. The first area 108 is thermally coupled to the sub-mount 102. The slug 106 also includes a post 112 protruding outwardly from the second area 110. In general, the post 112 is operably configured to be received in an opening in a heat sink (not shown in FIG. 1) to secure the LED apparatus to the heat sink while causing said second area to be thermally coupled to the heat sink. The heat sink may be a metal or alloy plate or fixture to which the LED 100 is to be mounted, for example. The post 112 and slug 106 may be formed together as a unitary body of thermally conductive material, such as aluminum or copper, for example.

In the embodiment shown in FIGS. 1 and 2, the LED 100 also includes a molded body 114 and a lens 116 for coupling and/or directing light generated by the LED die 102. The molded body 114 surrounds the slug 106 and provides mounting features for the lens 116.

The sub-mount 102 also includes one or more sub-mount electrodes (not shown) which are electrically coupled to the LED die 104. The LED 100 also includes a first terminal 118 for receiving a current supply conductor. The first terminal 118 may be a press-fit terminal that receives and secures a conductor wire, for example. The first terminal 118 is electrically coupled to a first pad 120 and the LED 100 further includes first connector 121 for connecting the between the first pad 120 and the sub-mount 102 to supply operating current to a first electrode on the sub-mount.

In the embodiment shown the LED 100 also includes a second pad 122, a second wire bond connector 124, and a second terminal (shown at 154 in FIG. 3) for supplying operating current to a second electrode on the sub-mount. In other embodiments the LED die 104 may be coupled to the slug 106 and the slug may act as the second current supply terminal for the LED 100.

LEDs require electrical current to operate, which is generally supplied through conductors connected to positive and negative terminals of the LED or the LED package. Alternatively, some LED's may be electrically configured such that either terminal can interchangeably function as positive or negative terminals, as is typical for conventional alternating current lighting components.

In one embodiment the lens 116 comprises an optically transparent material such as silicone gel having an outer surface 117 and extending between the sub-mount 102 and an outer surface 117 of the lens. Alternatively, the lens 116 may comprise a rigid lens material that encloses the sub-mount 102, with an optional filler material occupying a void between the outer surface 117 of the lens 116 and the sub-mount 102.

Figure 3:
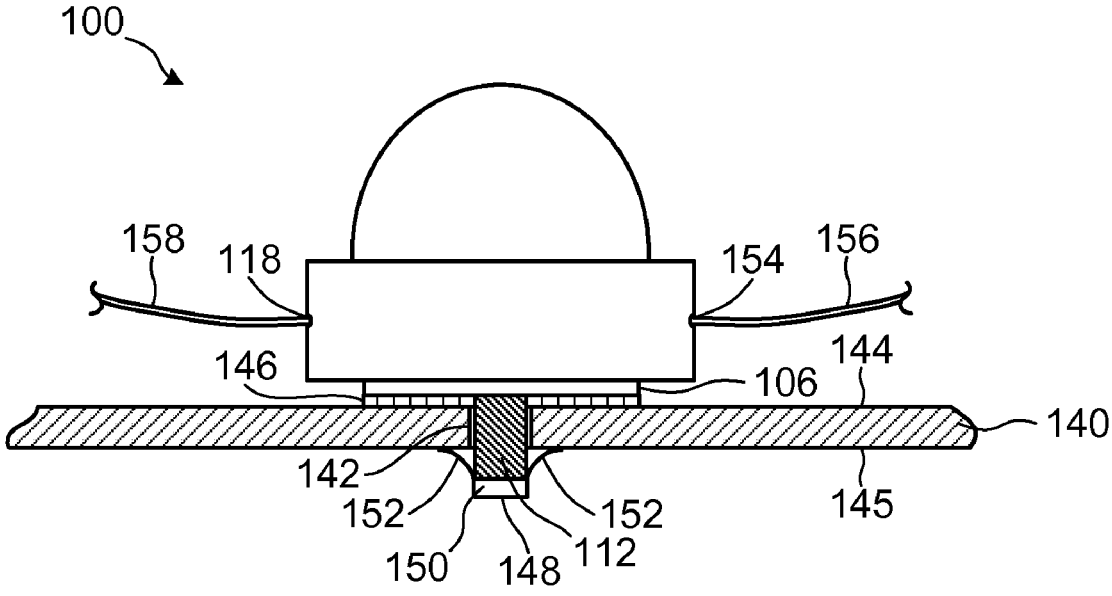
FIG. 3 is a cross sectional view of the LED apparatus of FIG. 1 mounted on a heat sink taken along line 3-3.

Referring to FIG. 3, in one embodiment the LED 100 is mounted on a metal heat sink 140 having a front surface 144 with a cylindrical opening 142 therein. In this embodiment, the opening 142 extends between a front surface 144 and a back surface 145 of the plate, and is dimensioned to receive the post 112.

The post 112 includes a distal portion 148 that protrudes through the opening 142 when the LED 100 is mounted on the plate. When mounting the LED 100, a spring clip 150 is placed on the distal portion 148 of the post 112. The spring clip 150 has at least one portion 152 (two portions 152 are shown in FIG. 3) that is operable to engage the back surface 145 of the heat sink to urge the second area 110 into thermal coupling with the front surface 144 of the heat sink 140.

The mounted LED 100 also has a thermally conductive material 146 disposed between the front surface 144 of the heat sink 140 and the second area 110 of the slug 106. Suitable thermally conductive materials include thermally conductive adhesive tape, phase change materials, thermally conductive elastomer pads, and graphite plate, for example. The thermally conductive material fills micro-voids and/or gaps between the front surface 144 and the second area 110 of the slug 106 that occur due to non-ideal surface finish and result in increased thermal resistance between the slug 106 and the heat sink 140.

Alternatively, the spring clip 150 may be integrally attached to the distal portion 148 of the post 112, and the portions 152 may be fabricated from sufficiently thin material (for example beryllium copper strips) to permit the spring clip portions to be compressed flush against the post 112, while the post is being inserted through the opening 142 in the heat sink 140. In this embodiment the thermally conductive material 146 should be sufficiently compliant to permit the spring clip portions 152 to clear the opening 142 and to spring outwardly to the position as shown while the LED 100 is being depressed against the front surface 144 of the heat sink. An example of a suitably compressible thermally conductive material is the Hyper Soft Thermally Conductive interface pad 5502S available from Sumiitomo 3M Limited Tape and Adhesive Division of Tokoyo, Japan.

Advantageously, once mounted, electrical connections may be easily made to the LED 100 by inserting a first current supply conductor 158 into the first terminal 118, and a second current supply conductor 156 into the second terminal 154. As described above in connection with FIGS. 1 and 2, the first and second terminals 118 and 154 are connected to the submount 102 for supplying operating current to the LED die 104.

Advantageously, the post 112 and corresponding opening 142 facilitate tool-free mounting of the LED 100 to the heat sink 140 in mechanical alignment with the heat sink. For best thermal performance, the size of the spring clip 150 and post should be minimized so as to increase the thermal transfer area between the slug 106 and the heat sink 140.

In an alternative embodiment, a recess (not shown) having a shape generally corresponding to the slug 106 may be formed in the heat sink 140 to facilitate alignment between the heat sink and the LED 100. When the LED 100 is operable to couple light into an optical distribution systems (not shown) having lenses, reflectors, and/or scattering surfaces, it may be desirable to precisely align the LED with respect to the optical distribution system. Such alignment may be facilitated by providing a recess for receiving and locating the slug 106 of the LED 100.

Figure 4:
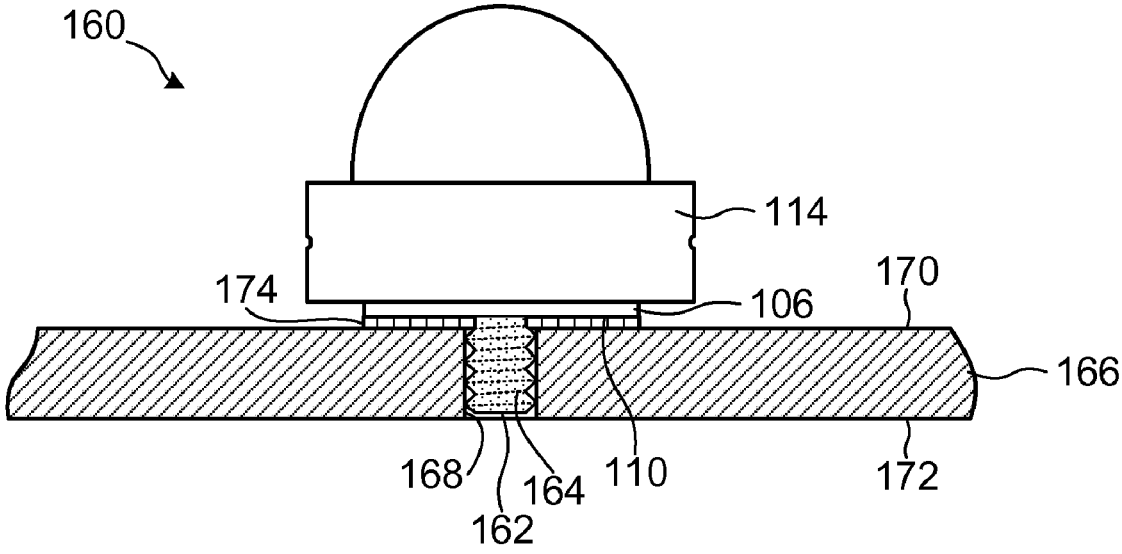
FIG. 4 is a cross sectional view of an LED apparatus in accordance with a second embodiment of the invention.

Referring to FIG. 4, in an alternative embodiment an LED 160 includes a post 162 having a threaded portion 164. The LED 160 is generally similar to the LED 100 shown in FIGS. 1 and 2 and includes the slug 106, first area 108 and the second area 110. The LED 160 is mounted on a metal heat sink 166 having a corresponding threaded opening 168. The threaded opening 168 may extend through the heat sink 166 from a front surface 170 to a back surface 172 of the heat sink 166. Alternatively, the threaded opening 168 may be a blind opening in the heat sink 166.

The mounted LED 160 also has a thermally conductive material 174 disposed between the front surface 170 of the heat sink 166 and the second area 110 of the slug 106. The LED 160 is screwed into the threaded opening 168 and tightened to cause the thermally conductive material to generally conform to the front surface 170 and the second area 110 of the slug, thus providing a good thermal coupling therebetween. Improved thermal coupling may be achieved by selecting a minimum diameter for the post 162, which is still operable to provide sufficient securing force thus maximizing the size of the second area in thermal coupling with the heat sink 166. The thickness of the heat sink 166 may be selected to allow engagement of a sufficient length of the threaded portion 164 of the post 162 in the threaded opening 168 for reliably securing the LED 160 to the heat sink (for example, twice the diameter of the post). In general, when the LED 160 is secured to the heat sink 166 with a torque sufficient to cause an optimal compression of the thermally conductive material, a thermal resistance between the first area 110 and the heat sink 166 is also minimized.

In an alternative embodiment, the molded body 114 may be shaped for engagement by a tool, such as a wrench to facilitate tightening the LED 160 to a desired torque for optimal thermal transfer.

Figure 5:
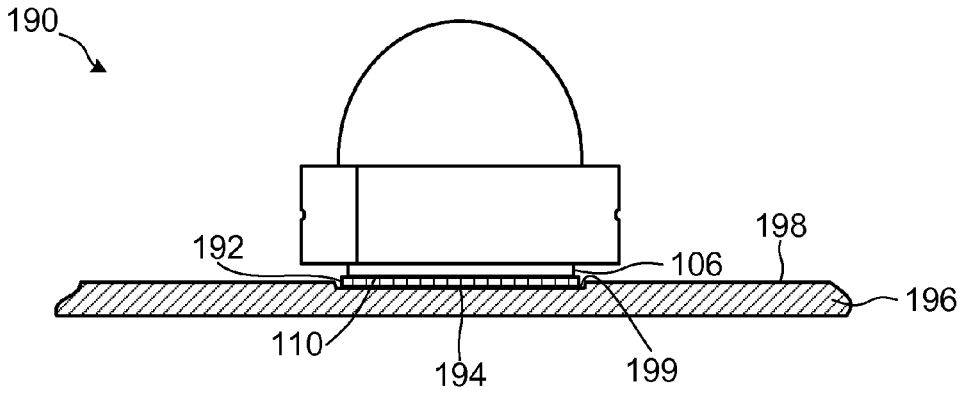
FIG. 5 is a cross sectional view of an LED apparatus in accordance with a third embodiment of the invention.

Referring to FIG. 5, in another embodiment an LED 190 includes a thermally conductive material 192 bonded to the second area 110 of the slug 106. The LED 190 is generally similar to the LED 100 shown in FIGS. 1 and 2 except that in this embodiment there is no protruding post on the second area 110. The thermally conductive material 192 includes an outer surface 194 having adhesive properties.

The LED 190 may be supplied with thermally conductive material already bonded to the second area 110 of the slug 106 with the outer surface 194 being protected by the removable protective film. When mounting the LED 190, the protective film is removed and the LED 190 is aligned to a heat sink 196 and pressured into contact with a first surface 198 of the heat sink. In this embodiment, the heat sink 198 includes a recess 199 having a shape that corresponds to the second area 110 of the LED 190. The recess 199 receives the second area 110 having the thermally conductive material 192 thereon, and facilitates alignment of the LED to the heat sink 196.

In general the thermally conductive material includes a thermally conductive material layer (not shown), with first and second adhesive layers on the inner and outer surfaces of the thermally conductive material layer. Suitable thermally conductive adhesive tapes are available from 3M Electronic Adhesives and Specialties Department of St. Paul, Minn. The 3M thermally conductive adhesive tapes have ceramic fillers and pressure sensitive adhesive surfaces having a removable protective film of silicone treated polyester disposed on the adhesive surfaces. For the 3M tapes, good adhesion may be achieved by maintaining a pressure of about 5-50 psi for about 2-5 seconds.

Advantageously, the LED 190 shown in FIG. 5 facilitates quick retrofit of many existing LED products, with the only specific requirement for the heat sink 196 being provision of a reasonably clean flat surface for bonding. The LED 190 may be securely bonded to the heat sink 196 without the need to allow for cure time, such as would be the case when using thermal conductive epoxies, for example. The bond may be permanent or semi-permanent, depending on the adhesive used to bond the thermally conductive material 192 to the second area 110 and the heat sink 196. When using the 3M tapes, removal of the LED 190 may be aided by applying heat to de-laminate the tape, which must be replaced, should it be desired to reattach the LED to the heat sink 196.

Figure 6:
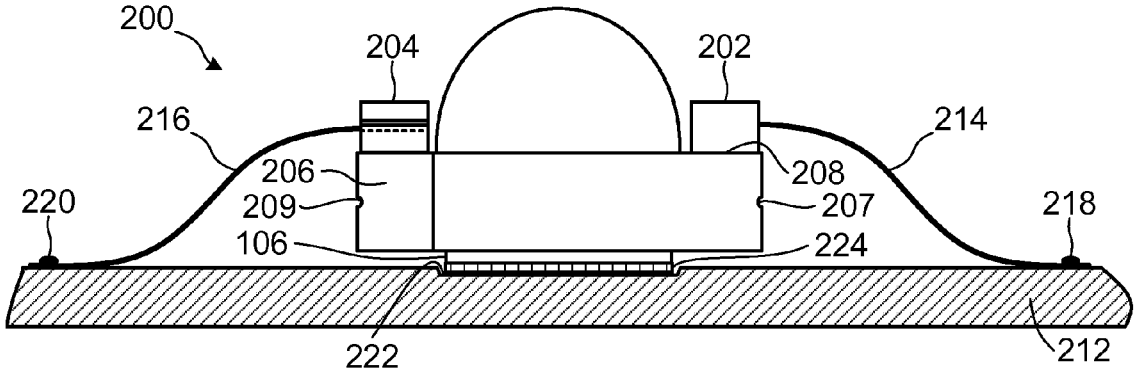
FIG. 6 is a cross sectional view of an LED apparatus in accordance with a fourth embodiment of the invention.

Referring to FIG. 6, in another embodiment an LED 200 includes a molded body 206 having a first lug 202 and a second lug 204 located on opposite sides of an upper surface 208 of the body. The first and second lugs 202 and 204 may be molded as part of the body 206. Alternatively, the lugs may be formed as part of the slug 106. The LED 200 also includes terminals 207 and 209 for receiving a current supply conductor. The terminals 207 and 209 may be a press-fit terminal that receives and secures a conductor wire, as described above in connection with FIG. 1.

The LED 200 is mounted on a heat sink 212, which has a first spring clip 214 and a second spring clip 216 attached to the heat sink. The spring clips 214 and 216 may be welded to the heat sink 212 at attachment points 218 and 220 respectively. In the embodiment shown in FIG. 6, the spring clips 214 and 216 are leaf springs, and may be fabricated from beryllium copper or stainless steel, for example. In other embodiments the springs 214 and 216 may be formed as part of the heat sink 212.

Figure 7:
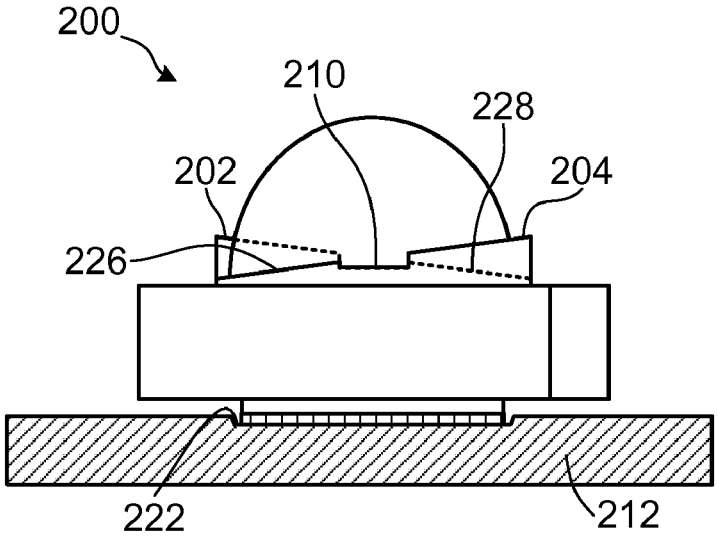
FIG. 7 is another cross sectional view of the LED apparatus shown in FIG. 6 taken in a direction orthogonal to the cross sectional view of FIG. 6.

Referring to FIG. 7, each lug 202 and 204 includes a slot 210 for receiving a free end of the respective spring clips 214 and 216 to cause the LED 200 to be pressured into contact with the heat sink 212. In the embodiment shown the heat sink 212 includes a recessed area 222, for receiving the LED 200. The recessed area 222 has a shape and size corresponding to the slug 106 and provides an alignment guide for locating the LED 200 on the heat sink 212. The recessed area also accommodates a thermally conductive material 224.

Figure 8:
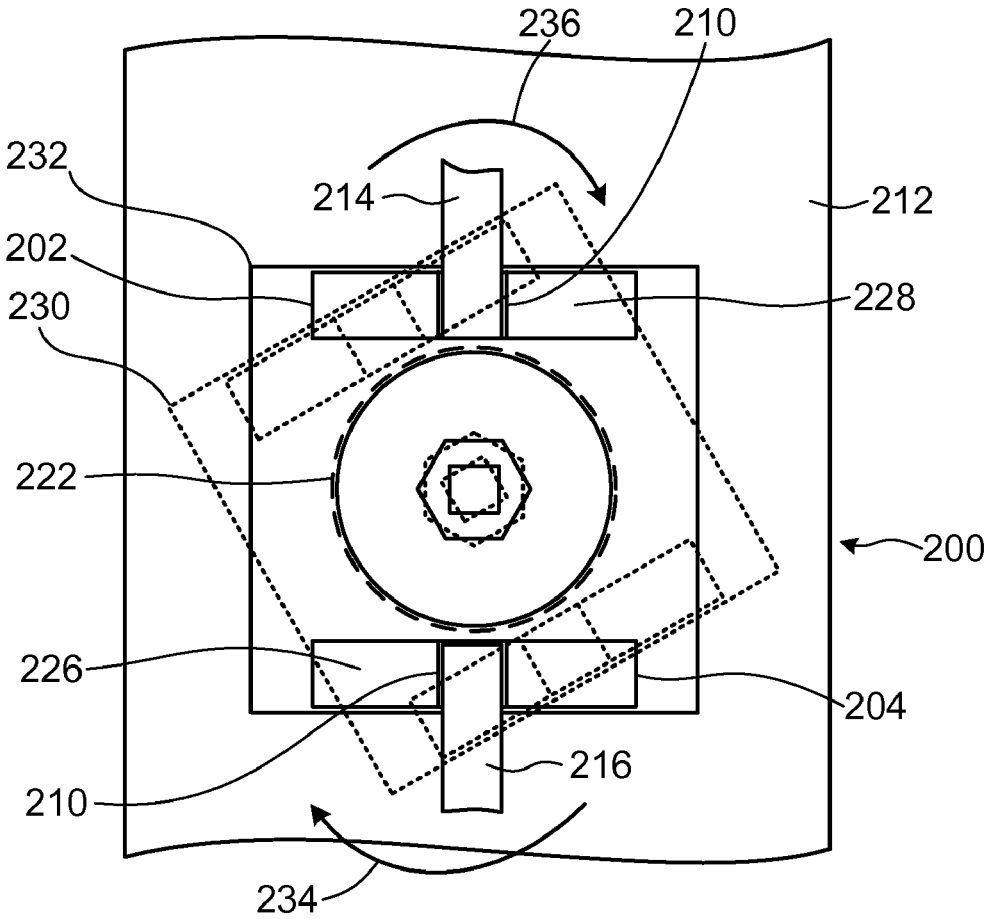
FIG. 8 is a plan view of the LED apparatus shown in FIG. 6 and FIG. 7.

In the embodiment shown in FIG. 6 and FIG. 7, the lugs 202 and 204 each include respective upwardly inclined ramp portions 226 and 228. Referring to FIG. 8, the ramp portions 226 and 228 are oriented to receive respective free ends of the spring clips 214 and 216 in the position 230 shown in broken outline. The LED 200 is then twisted in the direction of the arrows 234 and 236 to guide the free ends along the respective ramp portions 226 and 228 such that respective free ends of the spring clips 214 and 216 snap into engagement with the respective slots 210 in a position 232. When received in the respective slots 210, the free ends of the spring clips 214 and 216 apply a downward pressure and also prevent the LED 200 from rotating further, thus securing the LED to the heat sink 212.

In other embodiments, the lugs 202 and 204 and the ramps 226 and 228 may be omitted, and the slots 210 may be formed directly in an upper surface of the body 206 or the slug 106.

The LED 200 thus securely mounts the LED on the heat sink 212, while facilitating easy removal and replacement, should it be necessary to replace the LED. Advantageously by facilitating easy removal and replacement, the LED 200 may be replaced by relatively unskilled and untrained personnel in the field, thus avoiding replacement of an entire fixture that carries the LED.

Figure 9:
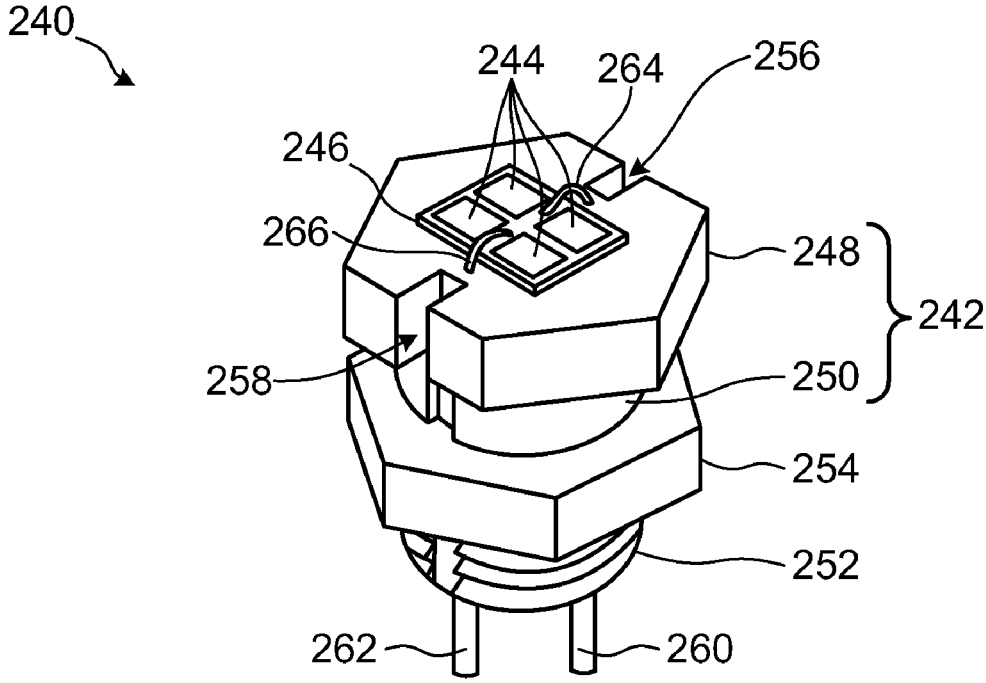
FIG. 9 is a perspective view of an LED apparatus in accordance with a fifth embodiment of the invention.

Referring to FIG. 9, in another embodiment an LED 240 includes a thermally conductive slug 242 for mounting a one or more LED die 244. In this embodiment four LED die 244 are shown mounted on a thermally conductive sub-mount 246, which is bonded to the slug 242. The sub-mount 246 may comprise silicon or a ceramic material, for example. The sub-mount 246 further includes pads (not shown) for connecting a current supply conductor to the LED die 244.

The slug 242 includes a mounting portion 248 for mounting the sub-mount 246, and a post 250. The post 250 includes a threaded portion 252 at a distal end of the post. In the embodiment shown in FIG. 9, the LED 240 includes a threaded nut 254 received on the threaded portion 252 of the post 250. The slug 242 is formed from a thermally conductive material such as aluminum, steel, or copper, for example.

In the embodiment shown in FIG. 9, the slug 242 comprises steel bolt having a surface coating of copper. Advantageously, the steel bolt is stronger than a copper or aluminum slug and generally has a lower cost. Steel also has a lower coefficient of thermal expansion (about 11 parts per million/° C.) than copper or aluminum (17 and 23 parts per million/° C. respectively). Materials used for mounting the LED die 244 generally have a low thermal coefficient of expansion (Silicon has a thermal expansion coefficient of about 3.2 ppm/° C.). Steel thus provides a lower expansion coefficient mismatch between the slug 242 and the die 244, thus reducing stress on the LED 240 due to temperature changes.

The LED 240 also includes first and second channels 256 and 258 which extend through the mounting portion 248 and the post of the slug 242. The channels 256 and 258 are operable to receive respective conductors 260 and 262 for supplying current to the LED die 244. The conductors 260 and 262 include respective bent over end portions 264 and 266, which are soldered or ultrasonically bonded to the pads on the LED die 244 for providing electrical connection to the die through the sub-mount 246. In embodiments where the slug 242 is electrically conductive, the conductors 260 and 262 should be electrically isolated from the first and second channels 256 and 258.

Figure 10:
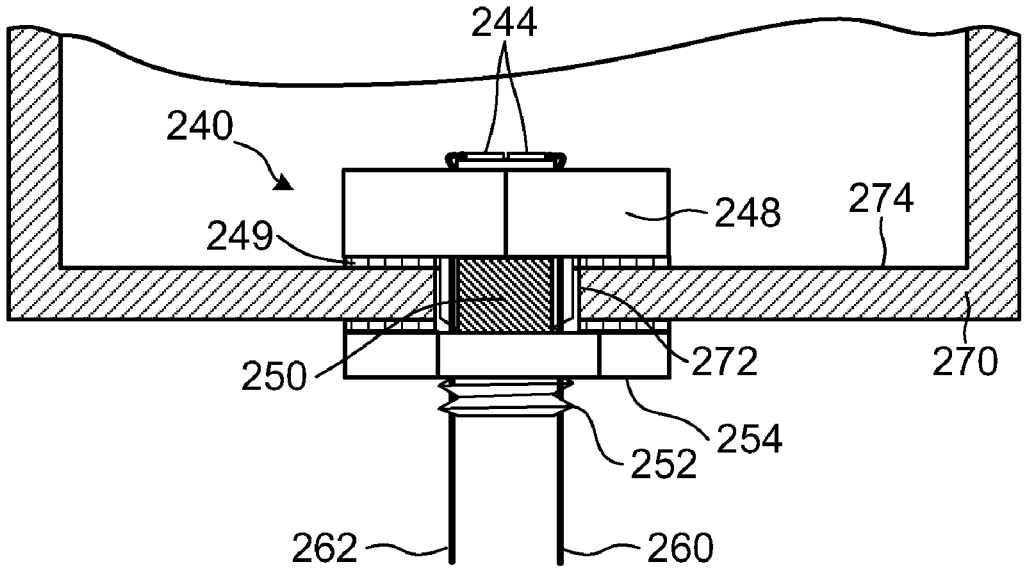
FIG. 10 is a cross sectional view of the LED apparatus shown in FIG. 9.

Referring to FIG. 10, the LED 240 is shown mounted to a heat sink 270. The heat sink 270 includes an opening 272 for receiving the post 250. A thermally conductive material 249 is disposed between a front surface 274 of the heat sink 270 and the mounting portion 248 of the slug 242. The LED 240 is secured to the heat sink 270 by engaging and tightening the threaded nut 254, thus causing the mounting portion 248 of the slug 242 to be urged into thermal coupling with the front surface 274 of the heat sink 270. The conductors 260 and 262 extend past the end of the threaded portion 252 of the post 250, and facilitate connection to a current supply for supplying operating current to the LED 240.

In the embodiment shown in FIG. 10, the heat sink 270 has a cylindrical can-shaped body, which further acts as a light reflector and/or light guide for collecting and directing the light generated by the LED die 244. The conductors 260 and 262 may be connected to a lighting fixture (not shown) on the ceiling of a room for suspending the LED apparatus. In other embodiments, the heat sink 270 may be a plate, or a heat sink having cooling fins, for example.

Figure 11:
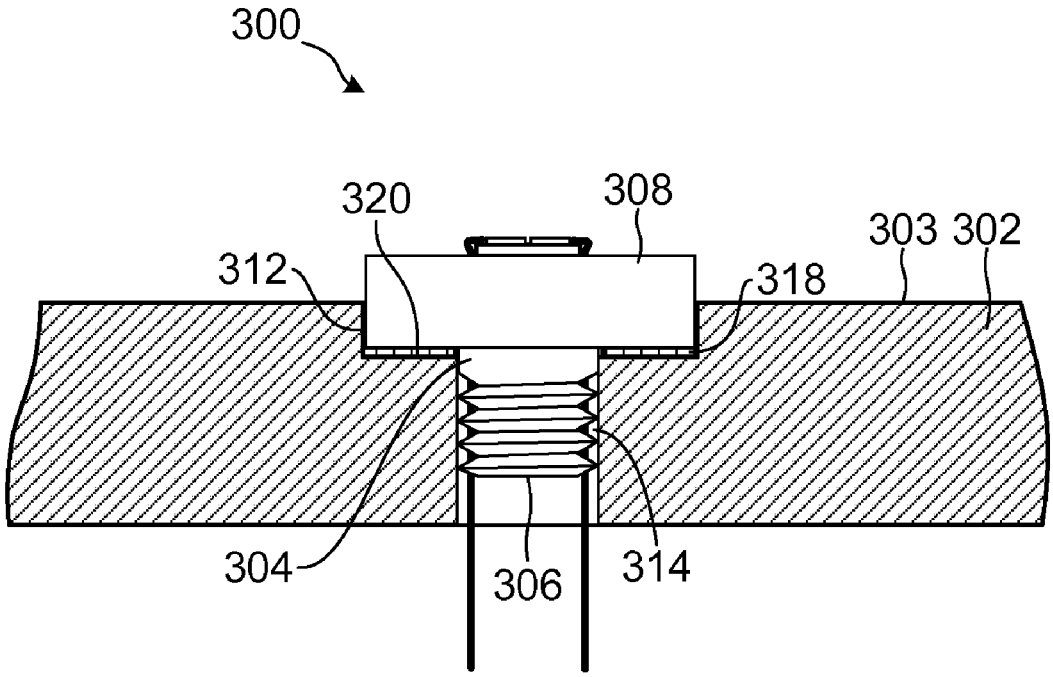
FIG. 11 is a cross sectional view of an LED apparatus in accordance with a sixth embodiment of the invention.

Referring to FIG. 11, a LED 300 is shown mounted to an alternative heat sink 302. The LED 300 is generally similar to the LED 240 shown in FIG. 9, having a post 304 with a threaded portion 306, but having a cylindrical body 308. The heat sink 302 includes a cylindrical recess 312 and a threaded opening 314 for receiving the threaded portion 306 of the post 304 for securing the LED 300. A thermally conductive material 318 is disposed between the body 308 and a surface 320 of the recess 312.

Advantageously, the LED 300 may be screwed into the threaded opening 314 and tightened to cause the thermally conductive material 318 to be compressed to provide thermal coupling between the body 308 and the heat sink 302.

Figure 12:
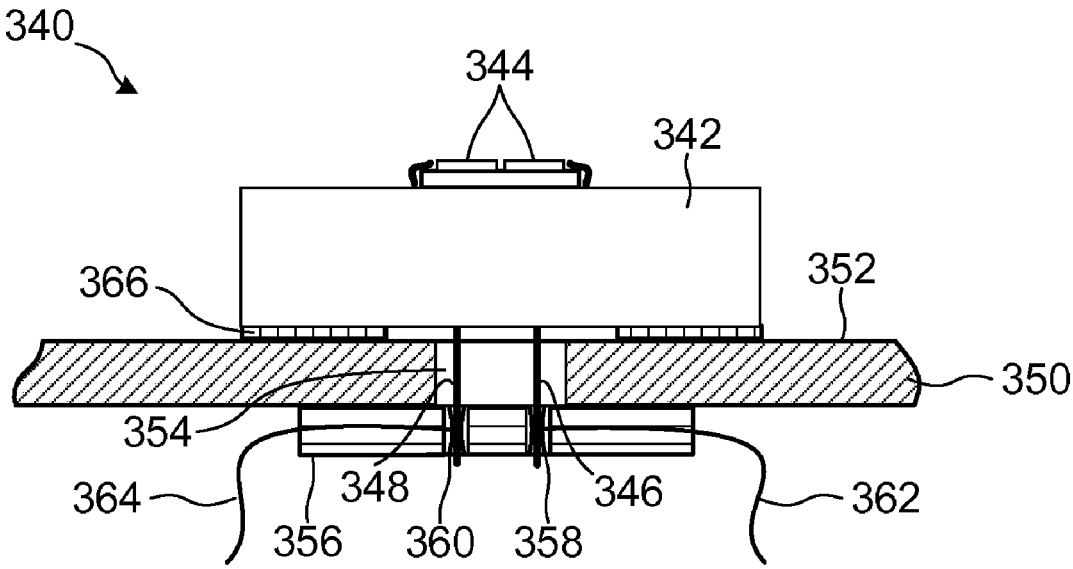
FIG. 12 is a cross sectional view of an LED apparatus in accordance with a seventh embodiment of the invention.

Referring to FIG. 12, in another embodiment an LED 340 includes a cylindrical body 342 for mounting one or more LED die 344. The LED 340 includes conductors 346 and 348 which are connected to the LED die 344 as described above in connection with FIG. 9.

The LED 340 is mounted on a heat sink 350 having a feed-through opening 354 for the conductors 346 and 348. The heat sink 350 also includes a connector block 356, which is secured to the heat sink and includes connection sockets 358 and 360 for receiving the respective conductors 346 and 348. The sockets 358 and 360 are respectively connected to current supply conductors 362 and 364 for supplying current to the LED 340.

The sockets 358 and 360 are generally similar to sockets used on printed circuit board assemblies for removably connecting electronic components to the board, and function to provide connection to the conductors 346 and 348 while simultaneously securing the LED 340 to the heat sink. The sockets 358 and 360 are configured to provide sufficient force to at least partially compress a thermally conductive material 366 between the body 342 and a front surface 352 of the heat sink 350, thus ensuring good thermal contact between the LED 340 and the heat sink.

Figure 13:
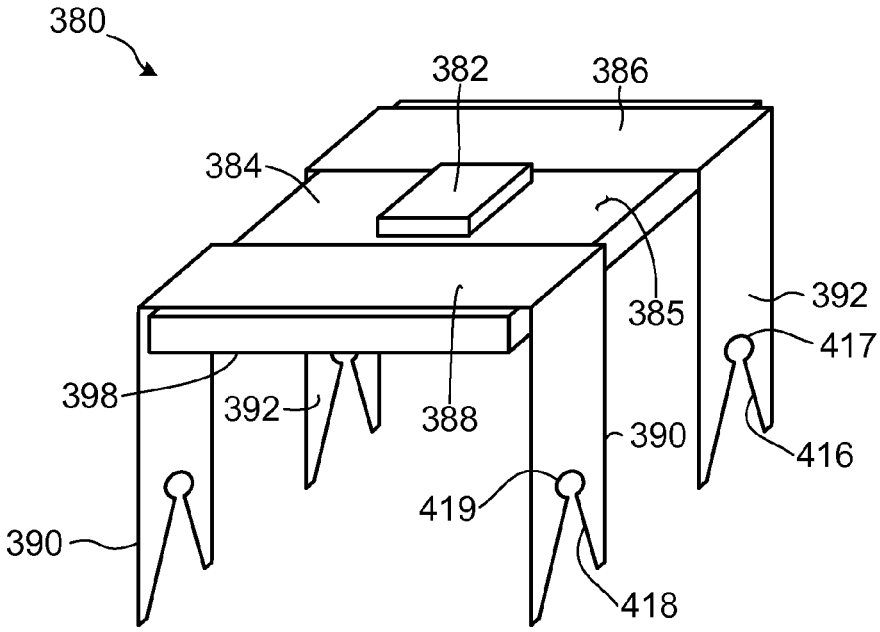
FIG. 13 is a perspective view of an LED apparatus in accordance with a eighth embodiment of the invention.

Referring to FIG. 13, in yet another embodiment an LED 380 includes a LED die 382, mounted on a first surface 385 of a sub-mount 384. The LED 380 also includes first and second elongate conductor strips 386 and 388 bonded to the first surface 385. In one embodiment the sub-mount 384 comprises a metalized ceramic having connection pads (not shown) for soldering the conductor strips 386 and 388 in place. The connection pads may further be in electrical connection with the LED die 382 for supplying operating current thereto.

The conductor strips each have downwardly depending connector portions 390 and 392 respectively. In the embodiment shown, the connector portions 390 and 392 are folded over to extend downwardly from the first surface 385 of the sub-mount 384.

Figure 14:
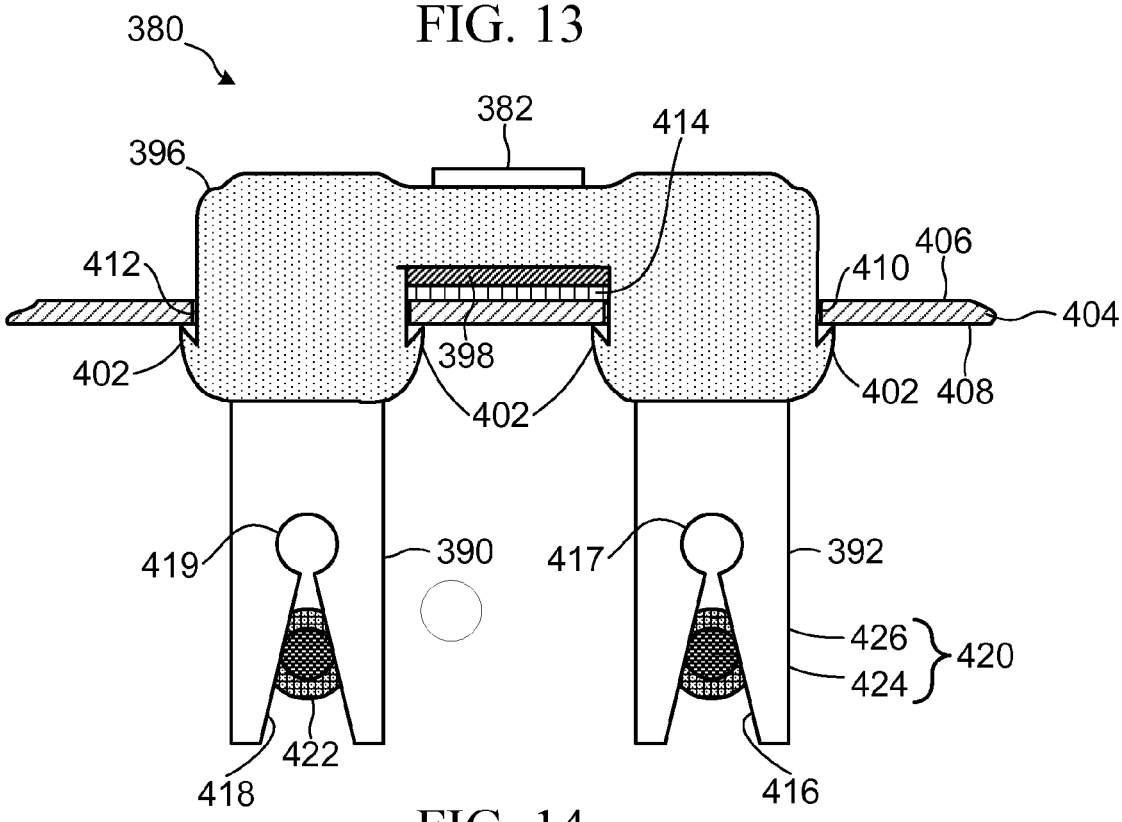
FIG. 14 is a cross sectional view of the LED apparatus shown in FIG. 13 mounted on a heat sink.

Referring to FIG. 14, the LED 380 is encapsulated in a plastic body 396, which surrounds the sub-mount 384 (except for the LED die 382 and a back surface 398 of the sub-mount). The body 396 also includes insertion snaps 402 molded into the body.

The LED 380 is mounted on a heat sink 404 having openings corresponding to the downwardly depending connector portions 390 and 392, of which openings 410 and 412 are shown. When mounting the LED 380, the insertion snaps 402 are received in the openings 410 and 412, and the body 396 is pressed downwardly until the insertion snaps 402 engage a back surface 408 of the heat sink 404. A thermally conductive material 414 is disposed between the back surface 398 of the sub-mount 384 and a front surface 406 of the heat sink 404, and under these conditions the back surface of the sub-mount is thermally coupled to the heat sink and secured in place. The thermally conductive material 414 may be a compliant material, such as the 3M hypersoft thermal pads, described above in connection with FIG. 5.

In the embodiment shown in FIG. 13 and FIG. 14, the downwardly depending connector portions 390 and 392 each have a "V" shaped cutout 416 and 418 for receiving insulated conductors 420 and 422 respectively. In this embodiment, the cutouts 416 and 418 also have circular portions 417 and 419 removed to permit ends of the connector portions to flex in the plane of the conductor portions. The insulated conductors each include a conductive core 424 and an insulation layer 426, and when the insulated conductors 420 and 422 are forced into the "V" shaped cutouts 416 and 418, the respective cutouts flex to engage the conductor by displacing the insulation to electrically contact the conductive core. The plastic body 396 prevents electrical shorting of the supplied current by insulating the leads from the heat sink 404.

As discussed in connection with the embodiments shown in FIG. 1 and FIG. 2, an optical element may be provided in any of the alternative embodiments described above. For example, referring to FIG. 14, the optical element may comprise a lens (not shown), which is pre-molded onto the sub-mount prior to attaching the conductive strips 386 and 388.

Figure 15:
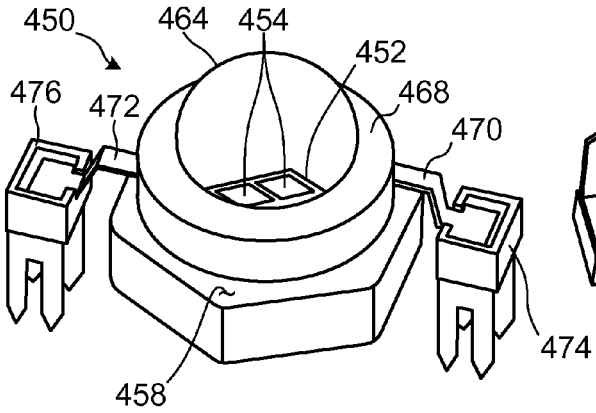
FIG. 15 is a perspective view of an LED apparatus in accordance with a ninth embodiment of the invention.
Figure 16:
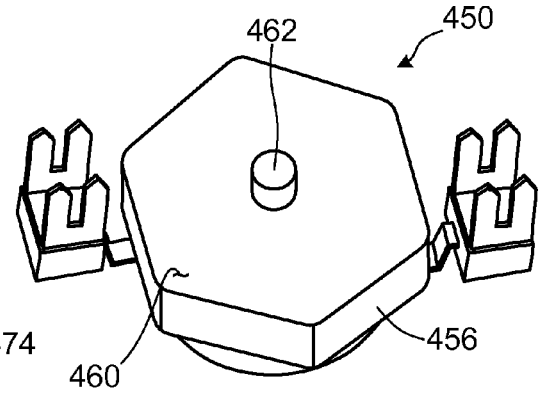
FIG. 16 is a perspective view of a second area of the LED apparatus shown in FIG. 15.

Referring to FIG. 15 and FIG. 16, in another embodiment an LED 450 includes a sub-mount 452 and at least one or more LED die 454 on the sub-mount. The LED 450 also includes a metallic slug 456 having first and second areas 458 and 460. The first area 458 is thermally coupled to the sub-mount 452. The slug 456 also includes a metallic stud 462 protruding from the second area 460.

In this embodiment the LED 450 includes a lens 464 for coupling and/or directing light generated by the LED die 454. The lens 464 is mounted in a molded body 468, which together with the lens surrounds and protects the LED die 454. The LED 450 also includes terminals 470 and 472 and respective connectors 474 and 476 for supplying operating current to the LED die 454. In this embodiment the connectors 474 and 476 are insulation displacement type connectors, such as described above in connection with FIG. 13 and FIG. 14. In other embodiments, press fit terminals such as the terminal 118 in FIG. 1 may be provided.

Figure 17:
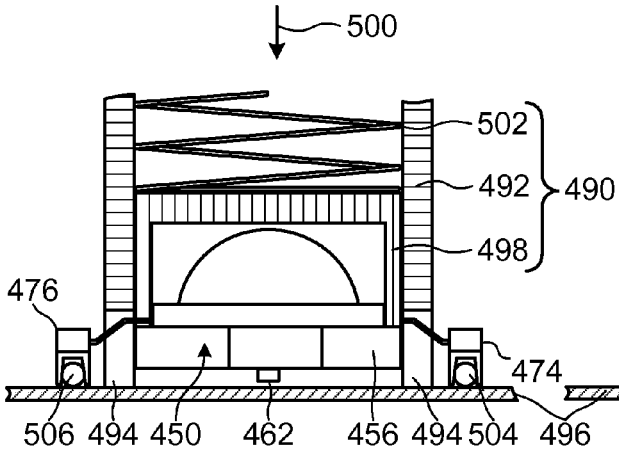
FIGS. 17-19 are a series of cross sectional views illustrating a process for welding the LED shown in FIG. 15 and FIG. 16 to a heat sink.
Figure 18:
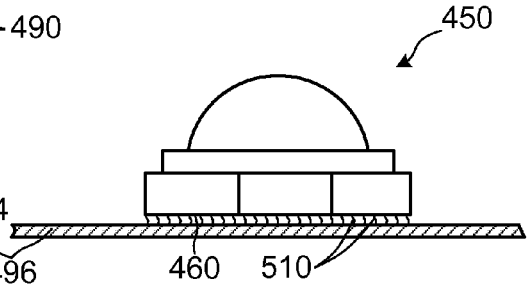

A process for mounting of the LED 450 is described with reference to FIG. 17-FIG. 19. Referring to FIG. 17, the LED 450 is received in a chuck 490 of a weld tool (not shown). The weld tool may be part of a capacitive discharge stud welding system such as the Nelson® CD Lite I system, available from Nelson Stud Welding of Elyria, Ohio. The Nelson system includes a power supply unit for charging a 66,000 μF capacitor to a voltage in the range of 50V-220V. The weld tool is configured to receive various chuck attachments for receiving a work-piece to be welded. The weld tool includes a cable for coupling to the capacitor, and further includes a switch for activating discharge of the capacitor through the chuck to the work-piece.

In this embodiment, the chuck 490 includes an outer sleeve 492 having insulated portions 494 for engaging a heat sink 496. The chuck 490 further includes a holder 498 for holding the LED 450 and for conducting the weld current from the charged capacitor to the metallic slug 456. The holder 498 is received in the sleeve 492 and is moveable in a direction indicated by the arrow 500 with respect top the sleeve. The chuck 490 also includes a spring 502 for urging the LED 450 toward the heat sink 496. In general, capacitive discharge stud welding systems facilitate adjustment of the urging force provided by the spring 502 to achieve a desired weld characteristic.

Prior to welding, the LED 450 is positioned such that the connectors 474 and 476 engage respective conductors 504 and 506. The chuck 490 is then placed over the LED 450 and the LED is initially positioned by the chuck 490 such that the stud 462 is proximate, but not in electrical contact with the heat sink 496. In other embodiments, the LED 450 may be loaded into the chuck 490 and then positioned with respect to the heat sink while being held in the chuck.

The power supply is also activated to charge the capacitor to a desired voltage. When the capacitor is charged, and the LED 450 is in a desired position, the weld tool switch is activated by the user, which causes the capacitor to discharge through the holder 498.

An initial current flow is concentrated through the stud 462 and establishes an arc between the stud and the heat sink 496 (which is usually held at a ground potential). The concentrated current flow results in a high current density through the stud 362 causing rapid heating of the stud, to an extent where the stud at least partially melts and/or vaporizes, thus permitting the second area 460 to move closer to the heat sink 496. As the second area 460 moves closer to the heat sink 496, a plurality of arcs 510 are established between the second area and the heat sink. The arcs 510 cause local melting of the slug 456 in the second area 460, and of the heat sink 496, which securely welds the LED 450 to the heat sink when the second area is subsequently brought into contact with the heat sink.

Figure 19:
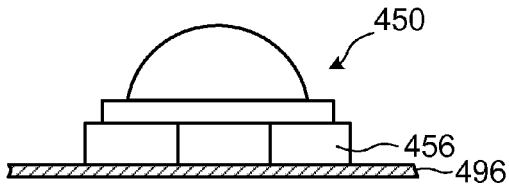

Referring to FIG. 19, the resulting weld between the slug 456 of the LED 450 and the heat sink 496 ensures a good thermal contact when the melted metal subsequently cools and solidifies.

Advantageously, the capacitive discharge stud welding system couples a large current through the stud 362 in a very short timeframe (for example, 9000 A over 4 miliseconds). The resulting heating of the stud 462 and the surrounding second area 460 is very rapid and heat dissipation is therefore minimized, thus localizing any damage or discoloration to the slug 456 and/or the heat sink 496.

Referring back to FIG. 17, in an alternative embodiment (known as contact capacitive discharge stud welding), the stud 462 may be positioned in electrical contact with the heat sink 496. Subsequently, when the switch is activated the welding current is coupled directly through the stud 462 to the heat sink 496. Contact capacitive discharge stud welding results in slightly longer weld times than embodiments in which the discharge is initiated when there is a gap between the stud 462 and the heat sink 496.

Advantageously, the stud 462 initializes the weld current in a desired location (i.e. at the center of the second area 460). However in other embodiments, the stud 462 may be omitted. In such cases the initial weld current establishes an arc between the second area 460 and the heat sink 496 and may require more careful alignment of the LED 450 with respect to the heat sink to ensure that the resulting weld is sufficiently uniform.

Advantageously, the LED's of the embodiments described herein provide for attachment to a heat sink without the use of solder, while providing good thermal coupling between the LED and the heat sink such that heat can be effectively transferred to the heat sink. Several of the embodiments described herein facilitate tool-free attachment to the heat sink, while other embodiments may be mounted using common hand tools or other convenient tools.

While specific embodiments of the invention have been described and illustrated, such embodiments should be considered illustrative of the invention only and not as limiting the invention as construed in accordance with the accompanying claims.

What is claimed is:

1. A light emitting diode (LED) apparatus for mounting to a heat sink, the heat sink having a front surface with an opening therein, the LED apparatus comprising:

a sub-mount;

at least one LED die mounted on said sub-mount; and a thermally conductive slug having first and second areas, said first area being thermally coupled to said sub-mount and said second area having a post protruding outwardly therefrom, said post being operably configured to be received in the opening in the heat sink and to secure the LED apparatus to the heat sink such that said second area is thermally coupled to the front surface of the heat sink.

2. The apparatus of claim 1 wherein said post comprises a threaded portion operable to engage a threaded portion of the opening in the heat sink for securing the LED apparatus to the heat sink.

3. The apparatus of claim 2 wherein said thermally conductive slug is operably configured to receive a wrench for applying a torque to secure the LED apparatus to the heat sink.

4. The apparatus of claim 2 wherein the heat sink comprises a base having said opening therein, and further comprises a cylindrical wall extending from said base and having an open end distal to said base, said cylindrical wall at least partially enclosing the LED apparatus and being operable to direct light generated by the LED die through said open end.

5. The apparatus of claim 1 wherein said post comprises a threaded portion, which when received in the opening in the heat sink protrudes from a back surface thereof and is operably configured to receive a threaded nut for securing the LED apparatus to the heat sink.

6. The apparatus of claim 1 wherein said post comprises a distal portion that protrudes from a back surface of the heat sink when received in the opening and wherein said distal portion is operably configured to receive a spring clip for engaging the back surface of the heat sink to urge the second area into thermal coupling with the front surface of the heat sink.

7. The apparatus of claim 1 further comprising:

a thermally conductive material disposed on said second area, said thermally conductive material being operable to form an interface between said second area and the front surface of the heat sink when the LED apparatus is mounted on the heat sink thereby lowering a thermal resistance therebetween; and a spring clip disposed on a distal portion of said post, said spring clip having at least one portion operably configured to be compressed flush against said post while being received in the opening in the heat sink, said thermally conductive material being sufficiently compliant to permit said LED apparatus to be depressed against the front surface of the heat sink to a sufficient extent to permit said at least one portion of said spring clip to engage the back surface of the heat sink to urge the second area into thermal coupling with the front surface.

8. The apparatus of claim 1 wherein said slug comprises at least one channel for receiving at least one conductor for supplying current to said at least one LED die.

9. The apparatus of claim 8 wherein said at least one channel extends through said post to facilitate routing said at least one conductor to the back surface of the heat sink.

10. The apparatus of claim 1 further comprising a thermally conductive material disposed on said second area, said thermally conductive material being operable to form an interface between said second area and said heat sink when said LED apparatus is mounted on the heat sink thereby lowering a thermal resistance therebetween.

11. The apparatus of claim 1 further comprising at least one terminal in electrical connection with said at least one LED die, said terminal being operable to receive and secure an electrical conductor for supplying operating current to said at least one LED die.

12. A light emitting diode (LED) apparatus for mounting to a heat sink, the LED apparatus comprising:

a sub-mount;

at least one LED die mounted on said sub-mount; and a thermally conductive slug having first and second areas, said first area being thermally coupled to said sub-mount; and a thermally conductive material disposed on said second area of said slug, said thermally conductive material having an outer surface having adhesive properties for securing the LED apparatus to the heat sink such that said second area is thermally coupled to the front surface of the heat sink.

13. The apparatus of claim 12 wherein said thermally conductive material comprises:

a thermally conductive material layer having an inner surface and an outer surface;

a first adhesive layer disposed on said inner surface, said first adhesive layer being operable to bond said thermally conductive material layer to said second area; and a second adhesive layer on said outer surface.

14. The apparatus of claim 13 wherein said slug is operably configured to be received in a corresponding recess in the heat sink, said recess being operable to facilitate alignment of the LED apparatus to the heat sink.

15. The apparatus of claim 13 further comprising a removable protective film disposed on said outer surface, said protective film being operably configured to be removed prior to securing the LED apparatus to the heat sink.

16. The apparatus of claim 12 further comprising at least one terminal in electrical connection with said at least one LED die, said terminal being operable to receive and secure an electrical conductor for supplying operating current to said at least one LED die.

17. A light emitting diode (LED) apparatus for mounting to a heat sink having a pair of spring clips attached to a front surface of the heat sink, each spring clip having a free end, the LED apparatus comprising:

a sub-mount;

at least one LED die mounted on said sub-mount; and a thermally conductive slug having first and second areas, said first area being thermally coupled to said sub-mount; and first and second slots located on opposite sides of an upper surface of the LED apparatus, said first and second slots being operable to receive respective free ends of the spring clips such that the second area of the slug is urged into thermal coupling with the heat sink when the LED apparatus is mounted on the heat sink.

18. The apparatus of claim 17 further comprising an electrically insulating body formed around at least a portion of said slug and wherein said first and second slots are formed in said electrically insulating body.

19. The apparatus of claim 17 further comprising an upwardly inclined ramp portion leading to each of said first and second slots, said ramp portion being oriented to receive respective free ends of the spring clips and being operable to guide the free ends into engagement with the respective first and second slots.

20. The apparatus of claim 17 wherein said second area of said slug is operably configured to be received in a recess formed in the front surface of the heat sink, said recess being operable to locate the LED apparatus on said heat sink.

21. The apparatus of claim 17 further comprising a thermally conductive material disposed on said second area, said thermally conductive material being operable to form an interface between said second area and said heat sink when said LED apparatus is mounted on the heat sink thereby lowering a thermal resistance therebetween.

22. The apparatus of claim 17 further comprising at least one terminal in electrical connection with said at least one LED die, said terminal being operable to receive and secure an electrical conductor for supplying operating current to said at least one LED die.

23. A light emitting diode (LED) apparatus for mounting to a front surface of a heat sink, the heat sink having at least one opening formed therethrough, the LED apparatus comprising:

a sub-mount having an upper surface and a lower surface;

at least one LED die mounted on said upper surface of said sub-mount;

a conductor strip bonded to said upper surface of said sub-mount adjacent said LED die and in electrical connection with said LED for supplying operating current thereto, said conductor strip having at least one connector portion that depends downwardly from said upper surface of said sub-mount; and an electrically insulating body molded around at least a portion of said connector portion and having an insertion snap proximate said connector portion, said insertion snap being operably configured to be received in the opening and to engage a back surface of the heat sink to secure the LED apparatus to the heat sink such that said lower surface of the sub-mount is thermally coupled to the front surface of the heat sink.

24. The apparatus of claim 23 wherein said connector portion comprises a v-shaped cutout at a distal end thereof, said v-shaped cutout being operable to receive a current supply conductor and to displace an insulation layer on said current supply conductor to establish electrical contact with the connector for supplying current to the LED die.

25. The apparatus of claim 23 further comprising a thermally conductive material disposed on said lower surface of said sub-mount, said thermally conductive material being operable to form an interface between said lower surface and said heat sink when said LED apparatus is mounted on the heat sink thereby lowering a thermal resistance therebetween.

26. A light emitting diode (LED) apparatus for mounting to a heat sink, the LED apparatus comprising:

a sub-mount;

at least one LED die mounted on said sub-mount; and a metallic slug having first and second areas, said first area being thermally coupled to said sub-mount and said second area having a metallic stud protruding outwardly therefrom, said stud being operably configured to conduct a welding current from said slug to the heat sink to cause the LED apparatus to be welded to the heat sink such that said second area is thermally coupled to the heat sink.

27. The apparatus of claim 26 further comprising at least one terminal in electrical connection with said at least one LED die, said terminal being operable to receive and secure an electrical conductor for supplying operating current to said at least one LED die.

28. A process for mounting a light emitting diode (LED) apparatus to a metallic heat sink, the LED apparatus including a sub-mount, at least one LED die mounted on the sub-mount, and a metallic slug having first and second areas, the first area being thermally coupled to the sub-mount, the method comprising:

causing the second area of the slug to be positioned proximate the heat sink; and coupling a charged capacitor to the slug to establish a welding current between the second area of the slug and the heat sink for welding the slug to the heat sink.

29. The process of claim 28 wherein causing the second area of the slug to be positioned proximate the heat sink comprises receiving the LED apparatus in a chuck, said chuck being operably configured to engage a surface of the heat sink such that the second area of the slug is positioned in spaced apart relation to the heat sink.

30. The process of claim 28 wherein causing the second area of the slug to be positioned proximate the heat sink comprises receiving the LED apparatus in a chuck, said chuck being operably configured to engage a surface of the heat sink such that the second area of the slug engages the heat sink.

31. The process of claim 28 wherein causing the second area of the slug to be positioned proximate the heat sink comprises causing a stud protruding outwardly from the second area of the slug to engage the heat sink, said stud being operable to conduct said welding current from the slug to the heat sink thereby melting the stud and at least a portion of the second area of the slug to cause the slug to be welded to the heat sink.

32. The process of claim 28 wherein causing the second area of the slug to be positioned proximate the heat sink comprises causing a stud protruding outwardly from the second area of the slug to be spaced apart from the heat sink, said stud being operable to conduct said welding current from the slug to the heat sink thereby melting the stud and at least a portion of the second area of the slug to cause the slug to be welded to the heat sink.

33. The process of claim 28 wherein coupling said charged capacitor to the slug comprises:

receiving the LED apparatus in a chuck, said chuck having a conductive portion for electrically contacting the slug; and coupling said charged capacitor to said conductive portion of said chuck.

* * * * *